United States Patent [19]

Kamada et al.

[11] Patent Number: 4,843,192

[45] Date of Patent: Jun. 27, 1989

[54] PUSH-BUTTON SWITCH DEVICE HAVING INDIVIDUAL/NTERLOCKING ACTION

[75] Inventors: Soetsu Kamada; Yujiro Shimoyama, both of Furukawa, Japan

[73] Assignee: Alps Electric Co., Ltd., Japan

[21] Appl. No.: 147,698

[22] Filed: Jan. 25, 1988

[30] Foreign Application Priority Data

May 7, 1987 [JP] Japan ..... 62-67405[U]

[51] Int. Cl.[4] ..... H01H 9/24

[52] U.S. Cl. ..... 200/50 C; 200/5 E; 200/524

[58] Field of Search ..... 200/50 C, 153 J, 153 JH, 200/5 E

[56] References Cited

U.S. PATENT DOCUMENTS 4,392,029 7/1983 Schaad et al. ..... 200/5 B 4,692,573 9/1987 Fukuyama ..... 200/153 J X

FOREIGN PATENT DOCUMENTS 61-47027 3/1986 Japan .

*Primary Examiner*—A. D. Pellinen

*Assistant Examiner*—Morris Ginsburg

*Attorney, Agent, or Firm*—Guy W. Shoup; Paul J. Winters; Stephen L. Malaska

[57] ABSTRACT

A push-button switch having an individual and interlocking action is provided which includes two operating members. The push-button switch comprises first and second sliders, each having a heart-shaped cam groove formed thereon. Actuator pins are provided for engagement with the cam grooves to provide the desired individual and interlocking action. The interlocking action is effectuated when the first slider is depressed while the second slider is locked at its depressed position. The invention allows the second slider to return to its unlocked nondepressed position while the first slider then becomes locked in its depressed position. The push-button switch has high versatility since the distance between the sliders can be easily changed. Further, common parts can be used individually for the sliders thus improving manufacturing efficiency.

9 Claims, 6 Drawing Sheets

PUSH-BUTTON SWITCH DEVICE HAVING INDIVIDUAL/NTERLOCKING ACTION

BACKGROUND OF THE INVENTION

This invention relates to a push-button switch device, and more particularly to a push-button switch device of the individual/interlocking action type wherein, when, for example, a first one of two buttons or keys is depressed, it is locked at its depressed position (individual action), and when a second one of the buttons is depressed with the first button locked at the depressed position, the second button is locked at its depressed position while at the same time the first button is released from its locked position (interlocking action).

Such a push-button switch device of the individual-/interlocking action type is disclosed, for example, in Japanese Patent Laid-Open No. 61-47027. The push-button switch device disclosed is shown in FIGS. 6 to 17*a* and 17*b* wherein FIG. 6 is a fragmentary perspective view of the individual/interlocking action push-button switch device, FIG. 7 a transverse sectional view of the individual/interlocking action push-button switch device of FIG. 6, FIG. 8 is a detailed view of a stopper pin and its associated parts, FIG. 9 a longitudinal sectional view of the push-button switch device of FIG. 6, FIG. 10 a detail view of an interlocking plate and its associated parts of the push-button switch device of FIG. 6, FIGS. 11 to 16 are detailed view of the stopper pin and the interlocking plate of the push-button switch device of FIG. 6, and FIGS. 17(*a*) and 17(*b*) are a sectional view and a front elevational view, respectively, showing details of a heart-shaped cam groove of the interlocking plate of FIG. 10.

Referring first to FIGS. 6 to 10, the push-button switch device shown includes a casing 31 having a plurality of fixed terminals 32 implanted thereon, and a pair of operating members 33*a* and 33*b* each mounted for sliding movement in the casing 31 to control a movable contact 34 and having a sectoral hole 35 formed in a side wall thereof. A pair of stopper pins 36*a* and 36*b* are received in the sectoral holes 35*a* of the operating members 33*a* and 33*b* for rocking motion in directions of arrow marks J in FIG. 8 each around a fulcrum 37 provided by an end thereof. A pair of springs 38*a* and 38*b* are provided for returning the operating members 33*a* and 33*b* to their inoperative positions, respectively. An interlocking plate 39 is accommodated in receiving recesses 42 of the casing 31 and mounted for pivotal motion around an axis of a pair of support shaft 43 at opposite ends thereof. The interlocking member 39 has a pair of heart-shaped cam grooves 40*a* and 40*b* formed therein for engagement with movable ends 41 of the stopper pins 36*a* and 36*b*, respectively. A torsion coil spring 44 is provided for urging the interlocking plate 39 to resiliently contact bottom faces 45*a* and 45*b* of the heart-shaped cam grooves 40*a* and 40*b* of the interlocking plate 39 with the movable ends 41*a* and 41*b* of the stopper pins 36*a* and 36*b*, respectively. The torsion coil spring 44 has an operating end 46 thereof received in an operating groove 47 of the interlocking plate 39 and has a fixed end 48 thereof received in a fixing hole 49 of the casing 31. A cover 50 is provided for guiding the operating members 33*a* and 33*b* and for preventing operating members 33*a* and 33*b* and the interlocking plate 39 from being let off the casing 31 and is secured to the casing 31 by means of a pair of projections 51 formed on the casing 31.

Now, operating of the interlocking push-button switch device having such a construction as described above will be described.

At first, an interlocking action will be described with reference to FIGS. 10 to 17 wherein FIG. 10 shows the push-button switch device in a condition wherein one switch unit K is in a released condition while the other switch unit L is in a locked condition, and FIGS. 11 to 13 are sectional views of the heart-shaped cam groove 40*a* of the switch unit K while FIGS. 14 to 16 show sectional views of the heart-shaped cam groove 40*b* of the switch unit L. If a depressing operation is effected for the switch unit K in the condition shown in FIG. 10, the movable end 41*a* of the stopper pin 36*a* for the switch unit K will trace the heart-shaped cam groove 40*a* in a direction indicated by an arrow mark from a point M in FIG. 17. Thus, after the movable end 41*a* of the stopper pin 36*a* comes to a face N of the heart-shaped cam groove 40*a* of the interlocking member 39, the interlocking plate 39 is pivoted around the axis of the support shafts 43 as seen in FIG. 12 through the engagement between the movable end 41*a* of the stopper pin 36*a* and the face N of the interlocking member 39. As the interlocking member 39 is pivoted, the movable end 41*b* of the stopper pin 36*b* for the other switch unit L is disengaged from a point Q of the heart-shaped cam groove 40*b* as shown in FIG. 15 to allow the switch unit L to be changed over from the locked condition of FIG. 14 to its released condition shown in FIG. 16, thereby completing a releasing action of the switch unit L. As the depressing operation of the switch unit K proceeds further, the movable end 41*a* of the stopper pin 36*a* will finally reach a full stroke point P. If the depressing force is removed in this condition, the switch unit K starts its releasing action, and at the point Q of the movable end 41*a* of the stopper pin 36*a* with respect to the heart-shaped cam groove 40*a* of the interlocking plate 39, the switch unit K is put into its locked condition, thereby completing an interlocking operation of the switch units K and L. It is to be noted that a similar interlocking action occurs where the switch units K and L are in the respective reverse conditions.

Now, a self locking operation will be described with reference to FIGS. 10 to 13 and 17. FIG. 10 shows the switch unit K in its released condition, and FIG. 11 shows a condition of the heart-shaped cam groove 40*a* in section when the switch unit K is in its released condition. It is to be noted that in this condition the movable end 41*a* of the stopper pin 36*a* of the switch unit K is positioned at the point M in FIG. 17. If a depressing operation is effected for the switch unit K in this condition, the movable end 41*a* of the stopper pin 36*a* will trace the heart-shaped cam groove 40*a* in the direction of the arrow mark until it passes a point N and reaches the full stroke point P. If the depressing force is removed in this condition, then the movable end 41*a* will trace in the direction of the arrow mark until it comes to the point Q at which the switch unit K is put into its locked condition. Here, if another depressing operation of the switch unit K is effected, the movable end 41*a* of the stopper pin 36*a* will trace in the direction of the arrow mark until another full stroke point R is reached. If the depressing force is removed here, then the movable end 41*a* will trace in the direction of the arrow mark until it returns to the point M whereupon the switch unit K restores its initial released condition. It is to be noted that a similar self locking operation occurs at the other switch unit L.

With such a conventional switch device as described above, since the two heart-shaped cam grooves 40*a* and 40*b* are formed in a predetermined spaced relationship in the interlocking plate 39, the distance between the operating members 33*a* and 33*b* which operate in association with the cam grooves 40*a* and 40*b*, respectively, is restricted of itself, and accordingly the switch device is low in versatility. Further, since the interlocking plate 39 is urged at a location displaced from the center thereof toward the movable ends 41*a* and 41*b* of the stopper pins 36*a* and 36*b* by the torsion coil spring 44 which is received at the operating end 46 thereof by the operating groove 47 of the interlocking plate 39 and at the fixed end 48 thereof by the fixing hole 49 of the casing 31, the urging forces acting upon the movable ends 41*a* and 41*b* are mutually associated with each other, and accordingly there is the possibility that the urging forces may not be balanced with each other. If good balancing therebetween actually fails, there is the possibility that the push lock mechanism may cause a malfunction.

SUMMARY OF THE INVENTION

Accordingly, it is an object of the present invention to provide a push-button switch device which is high in versatility with arbitrary setting of the distance of two operating members enabled and does not cause a malfunction.

In order the attain the object, according to the present invention, there is provided a push-button switch device which comprises a casing, first and second sliders mounted for sliding movement in the casing, first and second actuating pins supported for rocking motion on the first and second sliders, respectively, first and second cam plates having heart-shaped cams formed thereon for engagement with the first and second actuating pins, respectively, each of the first and second cam plates further having a cam bank formed thereon, a pair of springs for urging the first and second cam plates to resiliently engage the heart-shaped cams with ends of the first and second actuating pins, first and second push-button switches mounted on a bottom wall of the casing and each including a push-button, a pair of actuators mounted for sliding movement between two limit positions in the first and second sliders and in an opposing relationship to the push-buttons of the first and second push-button switches, a pair of spring elements for urging the actuators toward the push-buttons of the first and second push-button switches, a first cam element provided on the first slider for pressing engagement with the cam bank provided on the second cam plate, and a second cam element provided on the second slider for pressing engagement with the cam bank of the first cam plate.

With the push-button switch device of the present invention, since the cam plates on which the heart-shaped cams are provided individually for the first and second sliders, the distance between the sliders can be set to a desired value only by change of the casing design. Accordingly, the push-button switch device is high in versatility comparing with conventional push-button switch devices. Further, since the pressing forces between the ends of the actuating pins and the cam plates can be set individually and independently of each other, the push-button switch device will cause no malfunction. Besides, since common parts can be used individually for the sliders and several other parts, the push-button switch device can be produced efficiently and economically, and management of parts can be facilitated. In addition, if the push-button switches located below the actuators are designed for a high current and a low current, switching between a high current and a low current can be attained.

The above and other objects, features and advantages of the present invention will become apparent from the following description and the appended claims, taken in conjunction with the accompanying drawings.

DETAILED DESCRIPTION OF THE PREFERRED EMBODIMENT

Figure 4A:
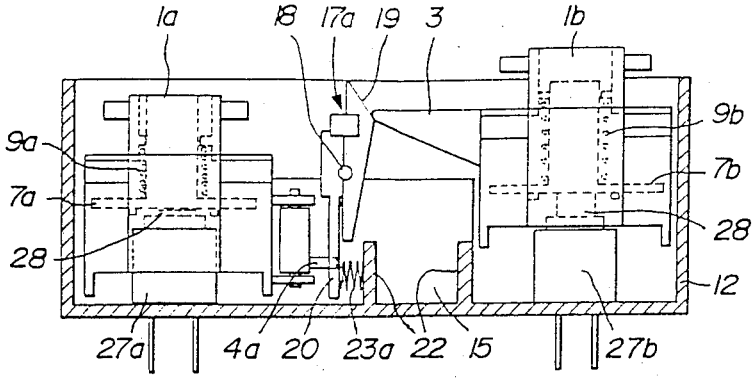
FIG. 4(*a*), 4(*b*) and 4(*c*) are side elevational sectional views illustrating different stages of an interlocking action, FIG. 4(*a*) showing a condition of the push-button switch device of FIG. 1 when only a first left-hand side slider is locked in a depressed position, FIG. 4(*b*) showing another condition when a second right-hand side slider is depressed while the first left-hand side slider is locked in the depressed position, and FIG. 4(*c*) showing a further condition when only the second right-hand side slider is locked in the depressed position.
Figure 4B:
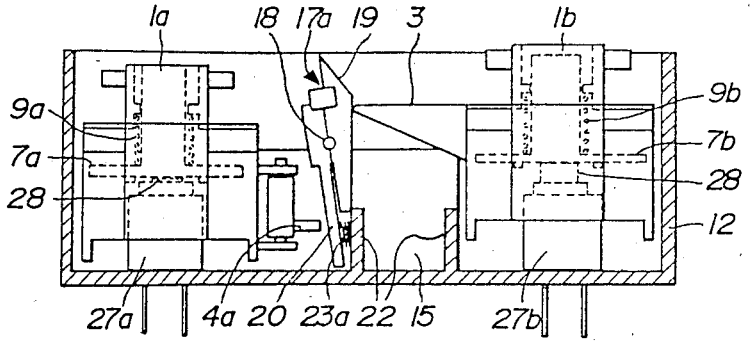
Figure 4C:
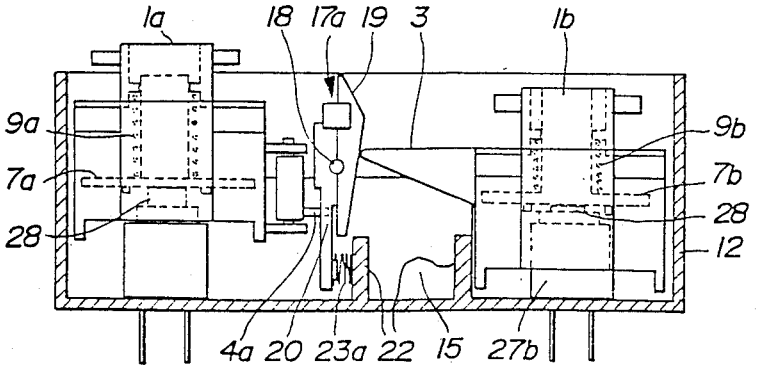
Figure 5A:
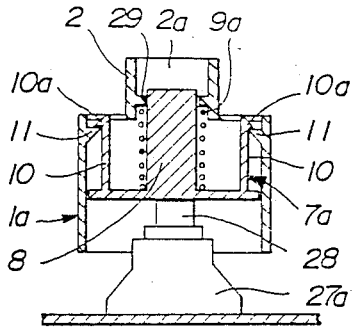
FIG. 5(*a*) is a sectional view showing the push-button switch device of FIG. 1 when a push-button switch thereof is not yet depressed by an actuator, and FIG. 5(*b*) is a similar view but showing the push-button switch device when the push-button switch is depressed by the actuator.
Figure 5B:
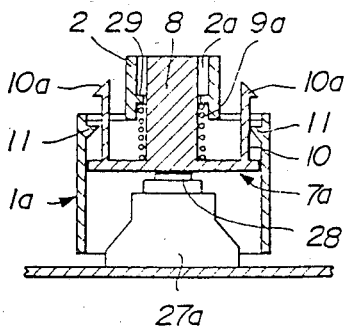
Figure 6:
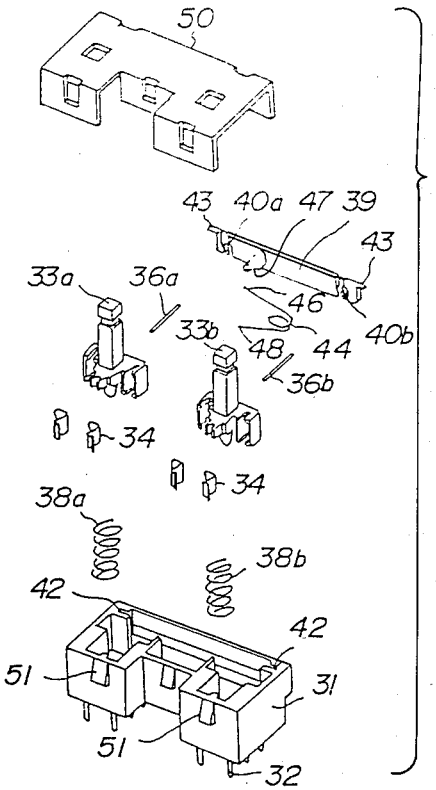
FIG. 6 is a fragmentary perspective view of a conventional push-button switch device of the individual-/interlocking action type.
Figure 7:
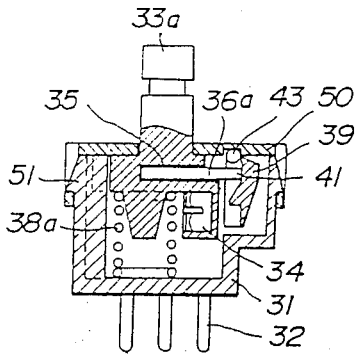
FIG. 7 is a transverse sectional view of the push-button switch device of FIG. 6.
Figure 8:
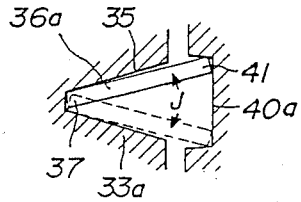
FIG. 8 is a detailed view of a stopper pin and its associated parts of the push-button switch device of FIG. 6.
Figure 9:
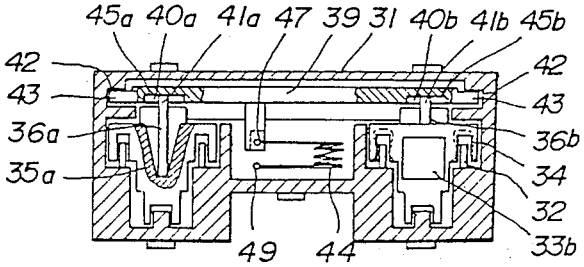
FIG. 9 is a vertical sectional view of the push-button switch device of FIG. 6.
Figure 10:
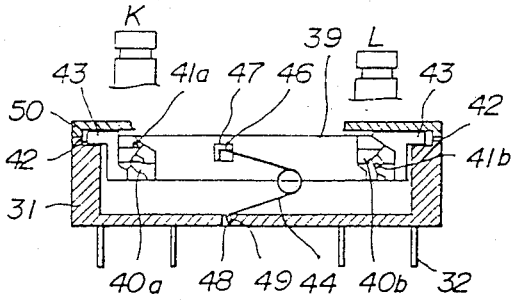
FIG. 10 is a detail view of an interlocking plate and its associated parts of the push-button switch device of FIG. 6.
Figure 11:
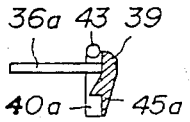
FIGS. 11 to 15 are detailed views of the stopper pin and the interlocking plate of the push-button switch device of FIG. 6.
Figure 12:
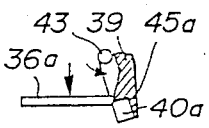
Figure 13:
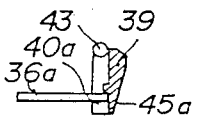
Figure 14:
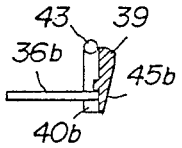
Figure 15:
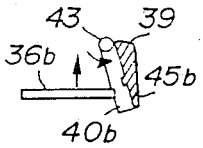
Figure 16:
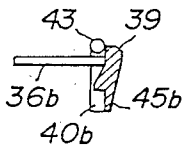
Figure 17A:
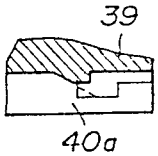
FIGS. 17(*a*) and 17(*b*) are a sectional view and a front elevational view, respectively, showing details of a heart-shaped cam groove of the interlocking plate of FIG. 10.
Figure 17B:
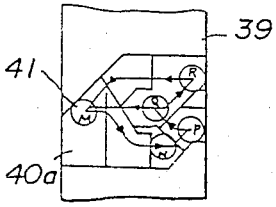

Referring to FIGS. 1 to 5(*a*) and 5(*b*), there is shown a push-button switch device embodying the present invention. The push-button switch device shown includes first and second sliders 1*a* and 1*b* each having a cylindrical portion 2 formed projectingly on an upper face thereof and each having a cam 3 formed projectingly on a side face thereof opposing to the other second or first slider 1*b* or 1*a*. A pair of actuating pins 4*a* and 4*b* are each supported for rocking motion on a pair of supporting members 6 formed on the side face of the slider 1*a* or 1*b*, respectively. First and second actuators 7*a* and 7*b* are mounted in the first and second sliders 1*a* and 1*b*, respectively., In particular, each of the first and second actuators 7*a* and 7*b* has a support post 8 formed at the center thereof, and a pair of compression springs 9*a* and 9*b* are fitted around the support posts 8 of the first and second actuators 7*a* and 7*b*, respectively, as seen in FIG. 5(*a*). Each of the support posts 8 of the first and second actuators 7*a* and 7*b* is inserted into a hole 2*a* of the cylindrical portion 2 of a corresponding one of the first and second sliders 1*a* and 1*b* with the spring 9*a* or 9*b* received at a projection 29 formed on an inner face of the first or second slider 1*a* or 1*b* until hooked portions 10*a* of a pair of arms 10 on opposite sides of the first or second actuator 7*a* or 7*b* are arrested by a pair of arresting portions 11 on an inner periphery of the first or second slider 1*a* or 1*b*. The push-button switch device further includes a casing 12 formed by molding and having formed therein a pair of accommodating portions 13 for the first and second sliders 1*a* and 1*b*. The accommodating portions 13 of the casing 12 are connected with each other by a pair of connecting walls 14. The casing 12 includes a first partition plate 15, and a pair of rails 16 formed on opposite sides of the first partition plate 15 for guiding the first and second sliders 1*a* and 1*b* thereon. The push-button switch device further includes first and second cam plates 17*a* and 17*b* each having a pair of shafts 18 formed projectingly on opposite sides thereof. A cam bank 19 is formed on a front side of each of the first and second cam plates 17*a* and 17*b* for engaging with the cam 3 of the first or second slider 1*a* or 1*b* while a heart-shaped cam 20 which is already known by itself is formed on the opposite face of each of the first and second cam plates 17*a* and 17*b*. The shafts 18 of each of the first and second cam plates 17*a* and 17*b* are supported on a pair of support members 21 provided on the connecting wall 14 and the first partition plate 15 so as to mount the first or second cam plate 17*a* and 17*b* for pivotal motion around an axis of the shafts 18. The push-button switch device further includes a pair of second partition plates 22 erected uprightly on a bottom wall of the casing 12 as shown in FIG. 4(*a*). The second partition plates 22 extend in a direction perpendicular to the first partition plate 15, and a pair of compression springs 23*a* and 23*b* are interposed between the second partition plates 22 and the first and second cam plates 17*a* and 17*b* for urging the first and second cam plates 17*a* and 17*b* to resiliently press the heart-shaped cams 20 of the cam plates 17*a* and 17*b* against ends of the actuating pins 4*a* and 4*b*, respectively. The push-button switch device further includes first and second push-button switches 27*a* and 27*b* secured to the bottom wall of the accommodating portions 13 of the casing 12. Each of the first and second switches 27*a* and 27*b* has a push-button 28 located for engagement with the first or second actuator 7*a* or 7*b*, respectively.

The first and second sliders 1*a* and 1*b* are loosely fitted in the accommodating portions 13 of the casing 12 with ribs 25 and 25' thereof received in rails 24 and the rails 16 and 16' formed in an opposing relationship on the inner peripheries of the accommodating portions 13 of the casing 12 and are arrested by pairs of hooks 26 formed on the top of the casing 12 so that they may be prevented from being pulled off upwardly.

Figure 1:
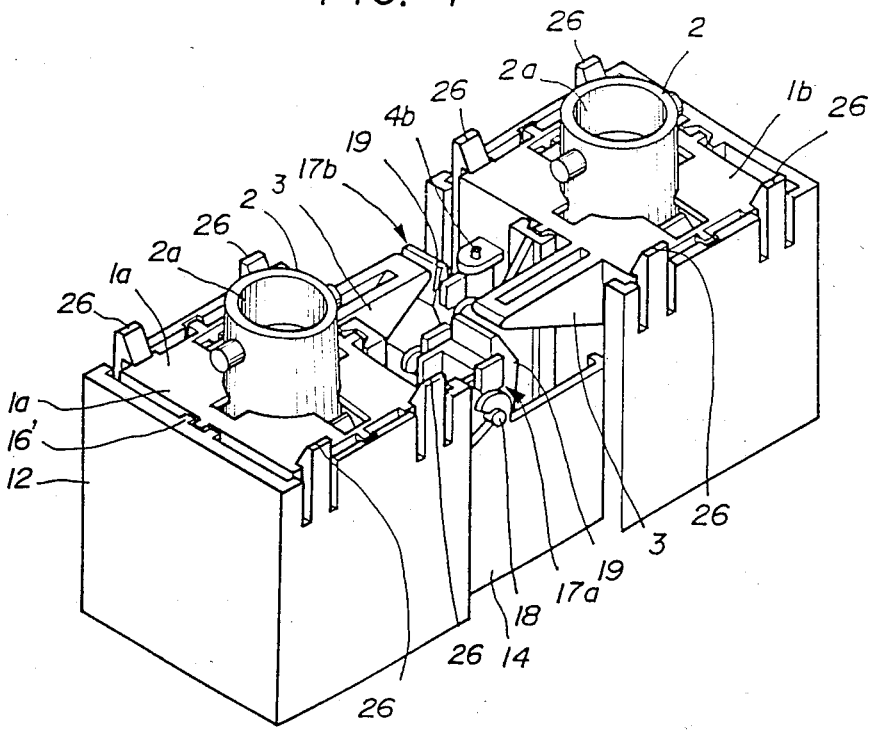
FIG. 1 is a perspective view of push-button switch device showing an embodiment of the present invention.
Figure 2:
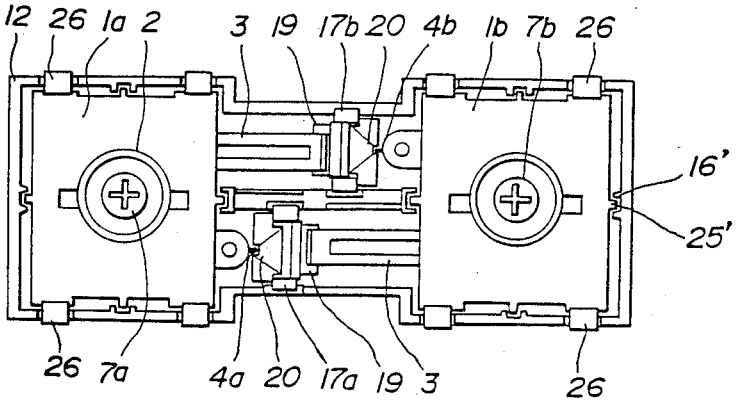
FIG. 2 is a plan view of the push-button switch device of FIG. 1.
Figure 3:
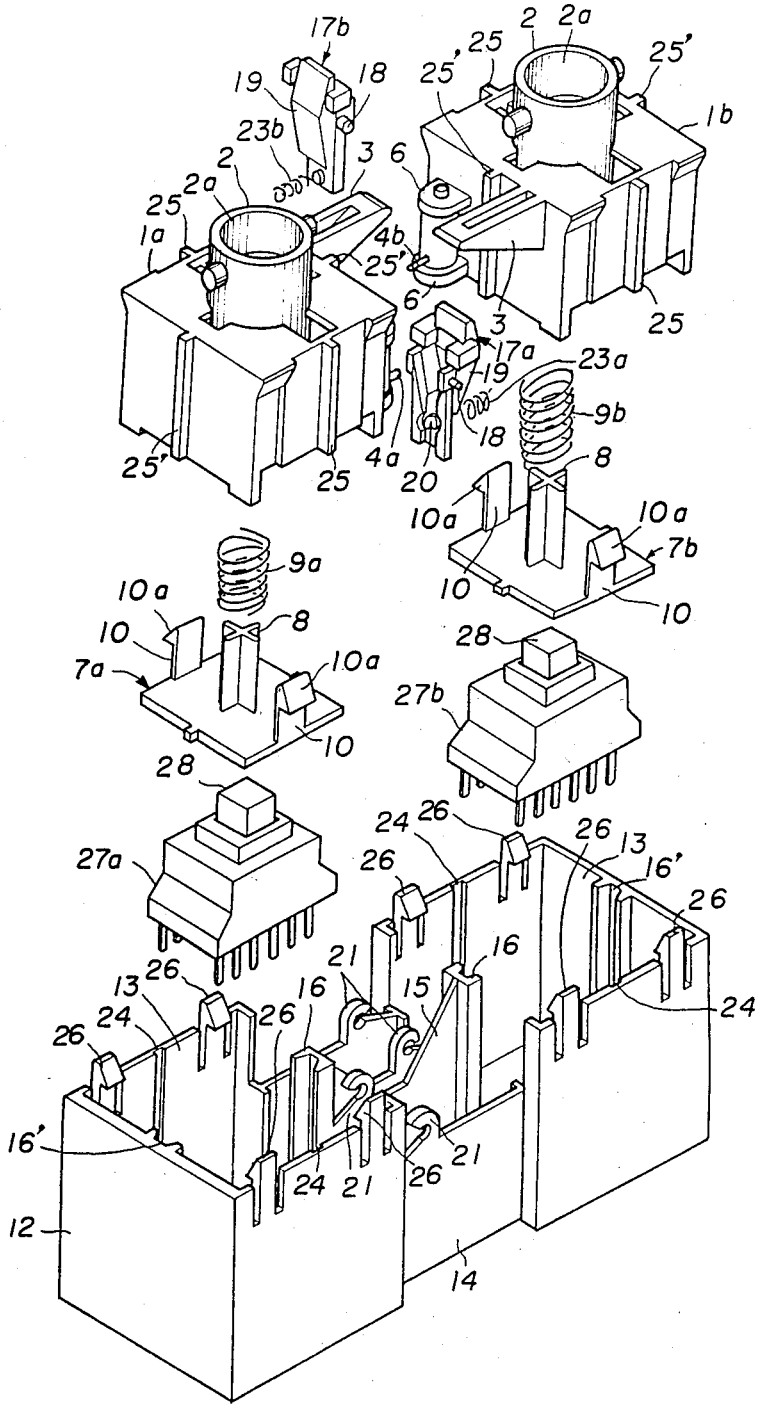
FIG. 3 is a fragmentary perspective view of the push-button switch device of FIG. 1.

In such an assembled condition as described above, the cam 3 of the first slider 1*a* is held in pressing engagement with the cam bank 19 of the second cam plate 17*b* while the cam 3 of the second slider 1*b* is held in pressing engagement with the cam bank 19 of the first cam plate 17*a* as shown in FIG. 1.

Now, operation of the push-button switch device will be described.

At first, if the first slider 1*a* is depressed when the first and second sliders 1*a* and 1*b* remain at their individual home or non-depressed positions, it will move down within the corresponding accommodating portion 13 of the casing 12 until the actuating pin 4*a* thereon is locked at the depressed position of the first slider 1*a* by the heart-shaped cam 20 of the first cam plate 17*a* as shown in FIG. 4(*a*). As the first slider 1*a* moves down in this manner, the first actuator 7*a* is pushed downwardly by way of the compression spring 9*a* to press against and push down the push-button 28 of the push-button switch 27*a* thereby to effect switching of the contacts as seen in FIG. 5(*a*). It is to be noted that while the cam 3 of the first slider 1*a* pushes the cam bank 19 of the second cam plate 17*b* to pivot the second cam plate 17*b* around the axis of the shafts 18 as the first slider 1*a* moves down, since the second slider 1*b* remains not pushed and the actuating pin 4*b* on the second slider 1*b* is not locked by the heart-shaped cam 20 of the second cam plate 17*b*, the second slider 1*b* maintains its non-depressed condition irrespective of pivotal motion of the second cam plate 17*b*.

Subsequently, if the second slider 1*b* is depressed in the condition of FIG. 4(*a*), then it is locked at its depressed position by a similar action to that described above whereupon the contacts of the second push-button switch 27*b* are switched. In mid course, the cam 3 of the second slider 1*b* slidably moves on and pushes the cam bank 19 of the first cam plate 17*a*. Consequently, the first cam plate 17*a* is pivoted around the axis of the shafts 18 as seen in FIG. 4(*b*) so that the heart-shaped cam 20 of the first cam plate 17*a* is disengaged from the actuating pin 4*a* on the first slider 1*a* whereafter the first cam plate 17*a* is pivoted back to its original position by the urging force of the spring 23*a* while the first slider 1*a* is returned to its non-depressed home position by the urging force of the spring 9*a* as seen in FIG. 4(*c*).

Similarly, if only the second slider 1*b* is depressed when the first and second sliders 1*a* and 1*b* remain at their individual non-depressed positions, the push-button switch device effects an individual action to switch the contacts of the switch 27*b*. Further, when the first slider 1*a* is depressed while the second slider 1*b* is locked at its depressed position, due to an interlocking action between the first and second sliders 1*a* and 1*b*, the second slider 1*b* is returned to its original non-depressed position while only the first slider 1*a* is locked at its depressed position and the contacts of the switch 27*a* are switched.

With the embodiment of the present invention described above, since the first and second cam plates 17*a* and 17*b* on which the heart-shaped cams 20 are formed are provided respectively for the first and second sliders 1*a* and 1*b*, the distance between the sliders 1*a* and 1*b* can be set to a desired value only by changing the design of the casing 12. Accordingly, the push-button switch device is high in versatility as compared to conventional push-button switch devices. Further, since the pressing forces between the ends of the actuating pins 4*a* and 4*b* and the first and second cam plates 17*a* and 17*b* can be set individually and independently of each other, the push-button switch device will cause no malfunction.

Besides, since common parts can be used individually for the sliders 1*a* and 1*b*, actuating pins 4*a* and 4*b*, actuators 7*a* and 7*b*, cam plates 17*a* and 17*b*, springs 9*a* and 9*b*, springs 23*a* and 23*b* and push-button switches 27*a* and 27*b*, the number of different types of parts can be reduced, which improves efficiency in management of parts. In addition, if the push-button switches 27*a* and 27*b* are designed for a high current and a low current, respectively, as desired, switching between a high current and a low current can be attained depending upon an application of the push-button switch device.

Having now fully described the invention, it will be apparent to one of ordinary skill in the art that many changes and modifications can be made thereto without departing from the spirit and scope of the invention as set forth herein.

What is claimed is:

1. A push-button switch device, comprising a casing, first and second sliders mounted for sliding movement in said casing, first and second actuating pins supported for rocking motion on said first and second sliders, respectively, first and second cam plates having heart-shaped cams formed thereon for engagement with said first and second actuating pins, respectively, each of said first and second cam plates further having a cam bank formed thereon, a pair of springs for urging said first and second cam plates to resiliently engage said heart-shaped cams with ends of said first and second actuating pins, first and second push-button switches mounted on a bottom wall of said casing and each including a push-button, a pair of actuators mounted for sliding movement between two limit positions in said first and second sliders and in an opposing relationship to said push-buttons of said first and second push-button switches, a pair of spring elements for urging said actuators toward said push-buttons of said first and second push-button switches, a first cam element provided on said first slider for pressing engagement with said cam bank provided on said second cam plate, and a second cam element provided on said second slider for pressing engagement with said cam bank of said first cam plate.

2. A push-button switch device according to claim 1, wherein said first and second actuating pins and said first and second cam elements are located on mutually opposing sides of said first and second sliders, respectively, and said first and second cam plates and said springs are located between said opposing sides of said first and second sliders.

3. A push-button switch device according to claim 2, wherein said first and second cam plates are each mounted for pivotal motion on a pair of parallel walls formed uprightly on said bottom wall of said casing.

4. A push-button switch device according to claim 2, wherein each of said springs are interposed between a partition wall formed uprightly on said bottom wall of said casing and an end portion of a corresponding one of said first and second cam plates.

5. A push-button switch device according to claim 1, wherein each of said spring elements is a compression spring having one end received by a projection formed on a corresponding one of said first and second sliders and the other end received by an upper face of a corresponding one of said actuators.

6. A push-button switch device according to claim 5, wherein each of said spring elements is a compression coil spring which is fitted around a support post formed uprightly on said upper face of the corresponding actuator.

7. A push-button switch device according to claim 1, wherein each of said actuators has a pair of hooked arms formed uprightly on an upper face thereof, and one of said two limit positions of each of said actuators is defined by said hooked arms of the actuator arrested by arresting portions of a corresponding one of said first and second sliders.

8. A push-button switch device according to claim 7, wherein the other limit position of each of said actuators is defined by said push-button of a corresponding one of said first and second push-button switches when said push-button is pushed down by the actuator.

9. A push-button switch device according to claim 1, wherein said first and second cam elements are formed in an integral relationship on said first and second sliders, respectively.

* * * * *

UNITED STATES PATENT AND TRADEMARK OFFICE

CERTIFICATE OF CORRECTION

PATENT NO. : 4,843,192

DATED : June 27, 1989

INVENTOR(S) : Soetsu Kamada and Yujiro Shimoyama

It is certified that error appears in the above-identified patent and that said Letters Patent is hereby corrected as shown below:

On the title page, item [54],

Title

"NTERLOCKING" should read -- INTERLOCKING --.

Signed and Sealed this

Seventeenth Day of April, 1990

*Attest:*

*Attesting Officer*

HARRY F. MANBECK, JR.

*Commissioner of Patents and Trademarks*